US011565781B1

(12) United States Patent
Feng et al.

(10) Patent No.: US 11,565,781 B1
(45) Date of Patent: Jan. 31, 2023

(54) HYBRID-DRIVEN MOORING CHAIN CLEANING AND STRUCTURAL INSPECTION UNDERWATER ROBOT AND WORKING METHOD THEREOF

(71) Applicants: CIMC Offshore Co., Ltd, Shenzhen (CN); Shanghai Ocean University, Shanghai (CN)

(72) Inventors: Wei Feng, Shenzhen (CN); Zhe Jiang, Shanghai (CN); Gaosheng Luo, Shanghai (CN); Biao Wang, Shanghai (CN); Wenqi Qin, Shenzhen (CN); Zhongjun Mao, Shanghai (CN); Naiyao Xue, Shenzhen (CN); Wei Bao, Shanghai (CN); Renjie Zheng, Shenzhen (CN); Chenchen Yang, Shenzhen (CN)

(73) Assignees: CIMC Offshore Co., Ltd, Shenzhen (CN); Shanghai Ocean Univerity, Shanghai (CN)

( * ) Notice: Subject to any disclaimer, the term of this patent is extended or adjusted under 35 U.S.C. 154(b) by 0 days.

(21) Appl. No.: 17/719,780

(22) Filed: Apr. 13, 2022

(30) Foreign Application Priority Data

Oct. 9, 2021 (CN) ..... 202111178201.7

(51) Int. Cl.
*B63C 11/52* (2006.01)
*B08B 3/02* (2006.01)
(Continued)

(52) U.S. Cl.
CPC ..... *B63C 11/52* (2013.01); *B08B 3/024* (2013.01); *B63G 8/001* (2013.01); *B63G 8/16* (2013.01); *B63G 2008/005* (2013.01)

(58) Field of Classification Search
CPC ..... B63C 11/52; B08B 3/024; B63G 8/001; B63G 8/16; B63G 2008/005
(Continued)

(56) References Cited

U.S. PATENT DOCUMENTS 8,619,134 B2 * 12/2013 Christ ..... G01N 29/07 348/84
2013/0298950 A1 * 11/2013 Hann ..... B08B 3/024 134/180
2021/0101666 A1 4/2021 Alam et al.

FOREIGN PATENT DOCUMENTS

CN 106428482 A 2/2017
CN 108776432 A 11/2018
(Continued)

*Primary Examiner* — Anthony D Wiest
(74) *Attorney, Agent, or Firm* — Nitin Kaushik

(57) ABSTRACT

The present invention is applicable to the technical field of marine equipment and provides a hybrid-driven mooring chain cleaning and structural inspection underwater robot and a working method thereof. The hybrid-driven mooring chain cleaning and structural inspection underwater robot includes at least one frame structure; a buoyancy system disposed on the frame structure and used for adjusting the buoyancy of the robot; a driving system disposed on the frame structure; underwater observation and communication systems disposed on the frame structure and used for underwater observation; a cleaning system disposed on the frame structure and used for cleaning a mooring chain; an active clasping/unclasping system disposed on the frame structure; and a structural inspection system disposed on the frame structure.

6 Claims, 4 Drawing Sheets

(51) Int. Cl.
*B63G 8/00* (2006.01)
*B63G 8/16* (2006.01)

(58) Field of Classification Search
USPC ..... 114/221 R, 222
See application file for complete search history.

(56) References Cited

FOREIGN PATENT DOCUMENTS

| | | | |
|---|---|---|---|
| CN | 208141172 | U | 11/2018 |
| CN | 109229310 | A | 1/2019 |
| CN | 110171549 | A | 8/2019 |
| CN | 110340062 | A | 10/2019 |
| CN | 110834707 | A | 2/2020 |
| CN | 112474527 | A | 3/2021 |
| CN | 112683340 | A | 4/2021 |
| CN | 113427491 | A | 9/2021 |
| CN | 113607218 | A | 11/2021 |
| JP | 2009189961 | A | 8/2009 |

* cited by examiner

HYBRID-DRIVEN MOORING CHAIN CLEANING AND STRUCTURAL INSPECTION UNDERWATER ROBOT AND WORKING METHOD THEREOF

CROSS-REFERENCE TO RELATED APPLICATIONS

The application claims priority to Chinese patent application No. 2021111782017, filed on Oct. 9, 2021, the entire contents of which are incorporated herein by reference.

TECHNICAL FIELD

The present invention relates to the technical field of marine equipment, in particular to a hybrid-driven mooring chain cleaning and structural inspection underwater robot and a working method thereof.

BACKGROUND

With demands on marine oil & gas exploitation and marine resource utilization, floating marine engineering equipment including a floating oil & gas production platform, an FPSO (Floating Production Storage and Offloading) device, a floating wind power platform, a floating fish net cage and the like is applied more and more widely. An anchor moored positioning system serving as an important part of the marine engineering equipment plays a role in keeping the offshore structures in a certain working area, and the safety of a mooring system concerns the safety of the offshore structures, facilities and people on them.

At present, FPSO devices in South China Sea, semi-submersible production and drilling platforms which are put into service and under construction and catenary buoy single-point moored crude oil transportation terminals have been positioned on the sea by adopting an anchor mooring system, and involved assets have reached more than 200 billion yuan. Once safety-related incidents are brought to the mooring system, huge economic loss will be caused, and meanwhile, serious marine environmental pollution may be brought. For example, the Thunder Horse platform of the BP company was struck by leg-like hurricane in 2005, which results in the failure of the mooring system and the collapse of the overall platform; and on May, 2006, seven mooring chains of the FPSO "Victory" were broken, and only three mooring chains keep mooring, which causes the Liuhua oilfield to halt production for one year. Therefore, the high-level detection and inspection technical capability for the mooring system and the safety guarantee for the marine engineering equipment are significant to marine oil & gas safety and marine environmental safety in China and should be paid more attention.

The anchor mooring system generally consists of a mooring rope and a pile foundation, and the mooring rope is generally in a mode of a rope formed by combining a mooring chain and a steel rope, a rope formed by combining a mooring chain, a steel rope and a fiber rope and the like according to different water depths. The floating marine engineering equipment is affected by environmental conditions such as wind, waves and water flows, a mooring chain is always in a motion state in water, and external environmental loads mainly act on the mooring chain and the pile foundation. In addition, the structure of the mooring chain may be damaged by the attached marine growths and seawater corrosion, the phenomenon such as anchor dragging may be caused by the continuous scouring of a bottom flow on the seabed. For all of these, higher requirements have been put forward to the technical means for detecting the mooring chain. In current engineering practice, four methods including visual check performed by recovering the mooring chain on a deck, nondestructive test (NIT) performed by bringing the mooring chain back to the shore, in-situ test performed underwater by a submariner and in-situ test performed by a working remotely operated vehicle (ROV) are generally adopted, but the visual check performed by recovering the mooring chain on the deck and the NTD performed by bringing the mooring chain back to the shore are inapplicable to a floating oil & gas production platform required to be permanently moored. In addition, there are huge safety problems and depth limitation of working capability for submariners to execute the job underwater. For a ROV, the cost of the equipment and operation cost of it is very expensive. In such circumstances, in order to overcome the above-mentioned technical bottleneck, the present patent provides a hybrid-driven mooring chain cleaning and structural inspection underwater robot and a working method thereof.

SUMMARY

The purpose of the present invention is to provide a hybrid-driven mooring chain cleaning and structural inspection underwater robot to solve the problems proposed in the background art.

In order to achieve the above-mentioned purpose, the present invention provides a technical solution described as follows.

A hybrid-driven mooring chain cleaning and structural inspection underwater robot, comprising at least one frame structure;

a buoyancy system disposed on the frame structure and used for adjusting the buoyancy of the robot;

a driving system disposed on the frame structure;

wherein the driving system comprises a propeller-propelled driving system and a wheel-type driving system; the propeller-propelled driving system is used for supplying power for underwater motions; and the wheel-type driving system is used for driving the robot to move on a mooring chain;

underwater observation and communication systems disposed on the frame structure and used for underwater observation;

a cleaning system disposed on the frame structure and used for cleaning the marine growths on mooring chains;

an active clasping/unclasping system disposed on the frame structure and used to be switched between two working states of underwater motions and chain climbing motion; and a detection system disposed on the frame structure.

Further, the buoyancy system comprises a plurality of buoyancy materials disposed on the frame structure.

Further, the propeller-propelled driving system comprises vertical propellers and horizontal propellers; the horizontal propellers are symmetrically disposed on the frame structure, and the vertical propellers are symmetrically disposed on the frame structure; and the vertical propellers and the horizontal propellers are respectively disposed on different main frames of the frame structure.

Further, the wheel-type driving system comprises two pairs of moving wheels disposed on the frame structure; and each pair of moving wheels is perpendicular to each other and is located on different planes.

Further, a clamping system comprises a lead screw and an adjusting spring, the adjusting spring is located on one side of each pair of moving wheels, the lead screw and a screw nut are matched on the other side of the adjusting spring, the other side of the adjusting spring is connected to the lead screw, the lead screw is rotatably installed on the frame structure, and the screw nut is disposed on an end of the lead screw.

Further, the cleaning system is located on the lowermost end of the frame structure, and the cleaning system comprises a high-pressure water gun disposed on the frame structure. The high-pressure water gun may be fixed to the buoyancy materials by using set screws.

Further, the active clasping/unclasping system comprises an external motor and an electromagnet, and the external motor and the electromagnet are oppositely disposed and are disposed on the top end of the frame structure.

The present invention provides another technical solution described as follows.

A working method of a hybrid-driven mooring chain cleaning and structural inspection underwater robot is provided, including the following steps:

gently placing the robot on a position near a mooring chain, at the moment, enabling the robot to be in a clasping state;

after the robot is placed underwater for a certain distance, enabling the robot to freely float to a position near the mooring chain under the drive of the propeller-propelled driving system;

switching the robot from the clasping state to an unclasping state, and then, driving, by the driving system, the robot to move; and enabling the mooring chain to enter the inside of the robot, at the moment, driving the external motor to switch the robot to the clasping state;

if the robot is incompatible with the mooring chain in specification, adjusting relative positions of the robot and the mooring chain;

locating the cleaning device carried by the robot below the robot, and driving, by an underwater motor, wheels of the robot to move along the mooring chain after the robot enters water, firstly, cleaning the mooring chain at the same time, locating the underwater observation and communication systems right above the robot, and keeping away from a turbid environment during work in a cleaning area; and after finishing the work, returning the robot to the water surface, and then, controlling the robot to be switched from the clasping state to the unclasping state, separated from the mooring chain, and then, restored to the clasping state, and recovering the robot by virtue of a mother ship.

Compared with the prior art, the present invention has the beneficial effects that:

1. by adopting a hybrid driving mode, the robot can autonomously reach a mooring chain working area to work in place; during work, the robot can be driven by wheels or a thrust to walk for work along the mooring chain; and after the work is finished, the robot autonomously returns the water surface and is recovered;

2. autonomous in-place installation on the mooring chain is achieved without the assistance of manpower;

3. during work, stable structural inspection work is achieved by controlling motions relative to the mooring chain; and 4. for the structural inspection work of the mooring chain, firstly, marine growths attached to the surface of the mooring chain need to be cleaned, and by carrying a spraying and rinsing head for cleaning, synchronous work of cleaning and structural inspection can be achieved, so that the work efficiency is increased; in addition, adopted is an open frame structure which can be flexibly adjusted and configured according to various work loads, thereby also facilitating maintaining equipment.

DETAILED DESCRIPTION OF THE EMBODIMENTS

Embodiment 1

Figure 1:
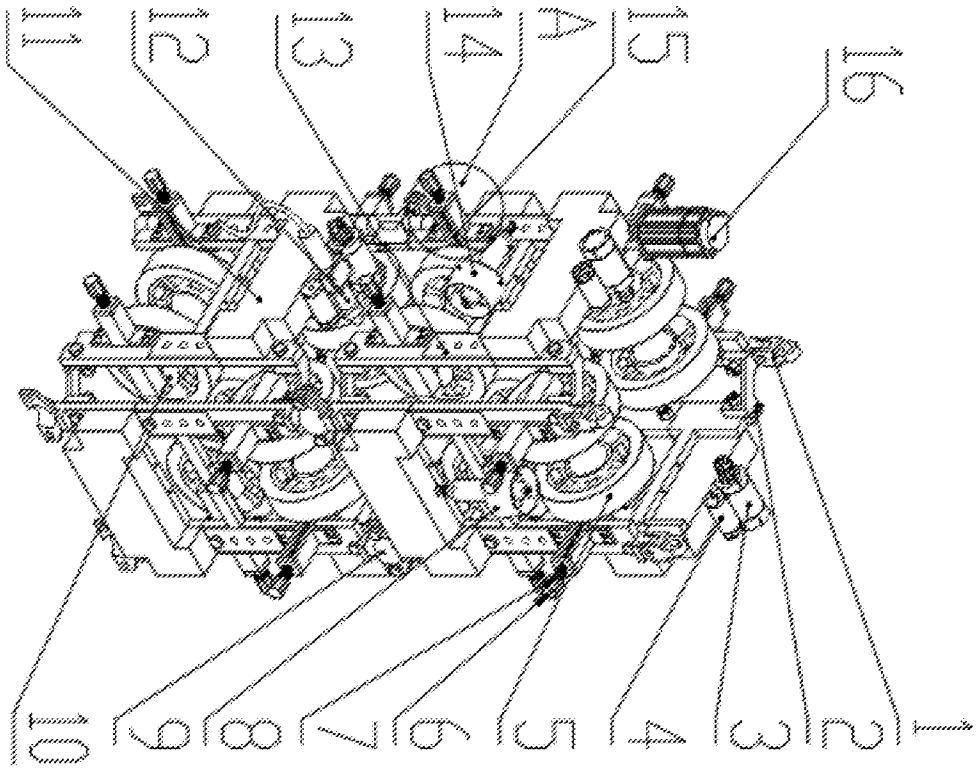
FIG. 1 is a schematic diagram showing a structure of a hybrid-driven mooring chain cleaning and structural inspection underwater robot.
Figure 2:
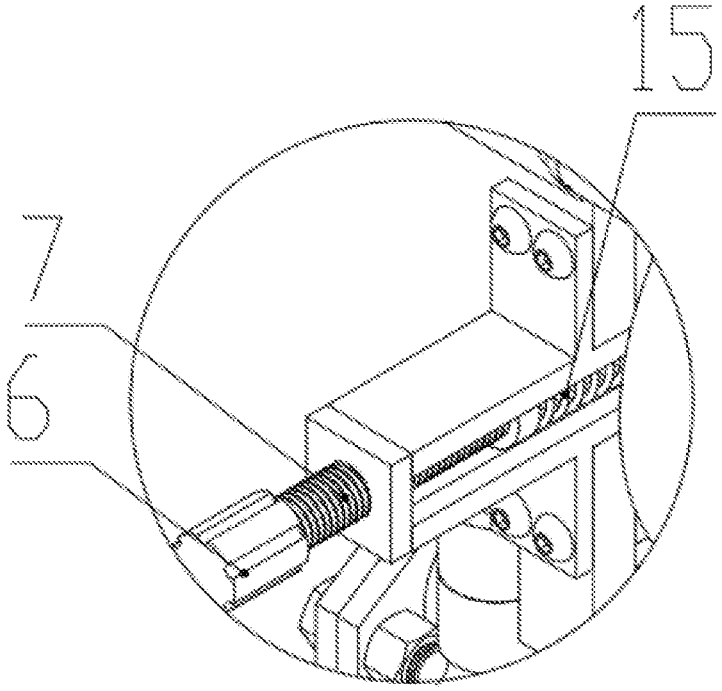
FIG. 2 is a schematic diagram showing an enlarged part A in FIG. 1.
Figure 3:
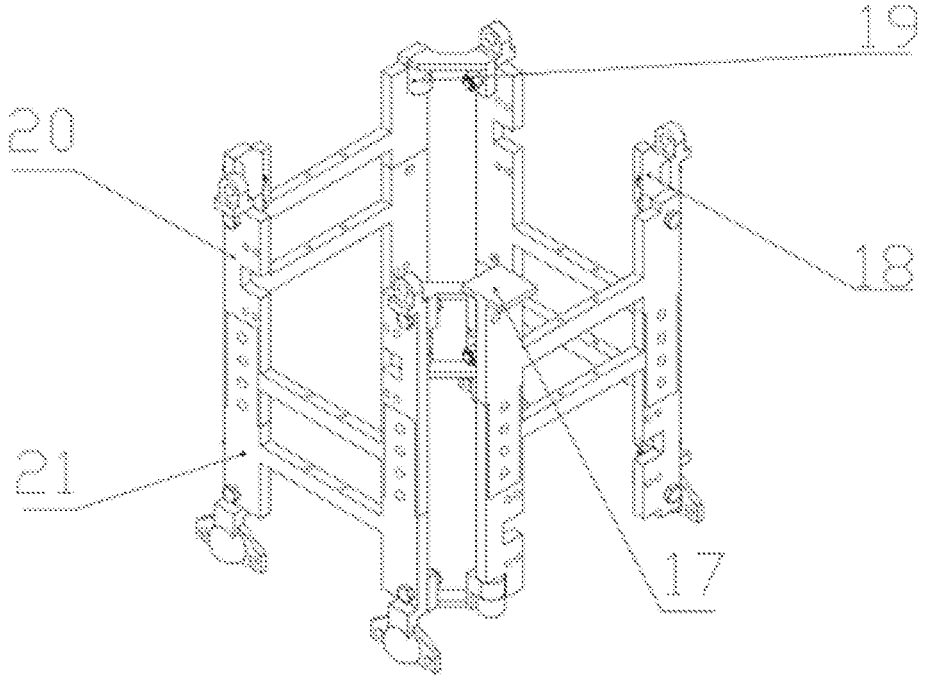
FIG. 3 is a schematic diagram showing an overall structure of an outer frame in the hybrid-driven mooring chain cleaning and structural inspection underwater robot.
Figure 4:
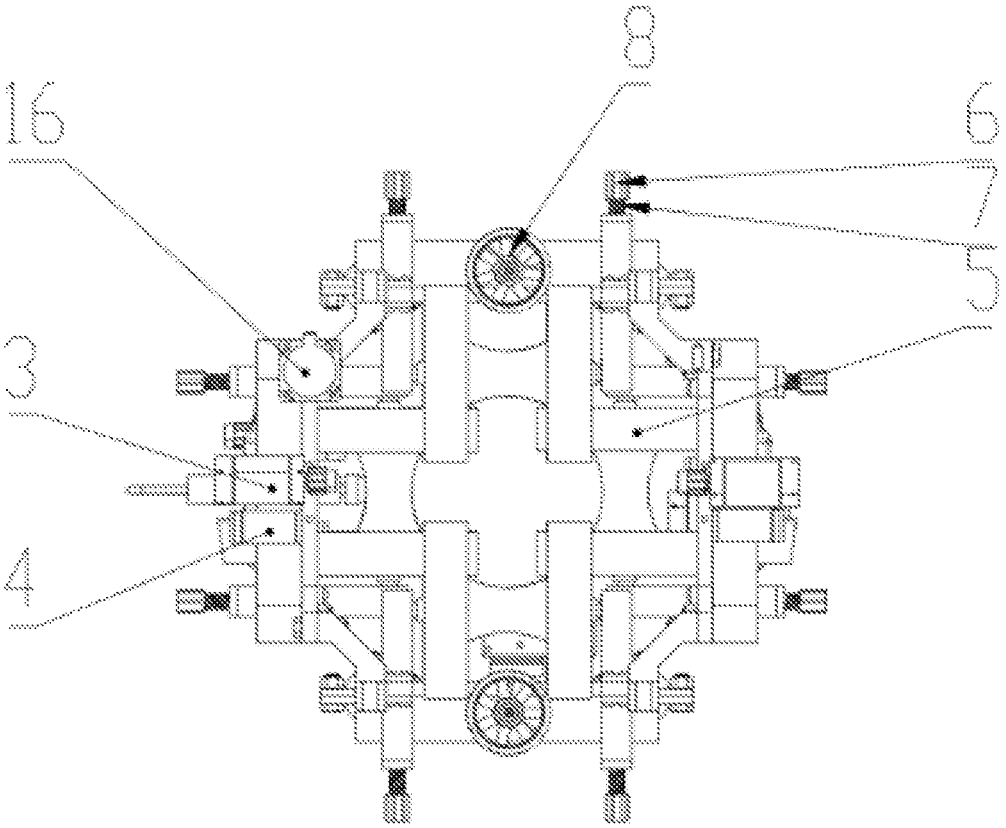
FIG. 4 is a top view of the hybrid-driven mooring chain cleaning and structural inspection underwater robot.

Reference is made to FIG. 1 to FIG. 4 which are structural diagrams of a hybrid-driven mooring chain cleaning and structural inspection underwater robot provided in the embodiment 1 of the present invention, comprising at least one frame structure; a buoyancy system disposed on the frame structure and used for adjusting the buoyancy of the robot; a driving system disposed on the frame structure; wherein the driving system comprises a propeller-propelled driving system and a wheel-type driving system; the propeller-propelled driving system is used for supplying power for underwater motions; and the wheel-type driving system is used for driving the robot to move on a mooring chain; underwater observation and communication systems disposed on the frame structure and used for underwater observation; a cleaning system disposed on the frame structure and used for cleaning the mooring chain; an active clasping/unclasping system disposed on the frame structure and used to be switched between two working states of underwater motions and chain climbing motion; and a structural inspection system disposed on the frame structure.

The frame structure is a main structure used for carrying all systems, an outer frame is provided with main frames 13 including left frames and right frames, one side of each of the left frame and one side of each of the right frame are rotatably installed together, and the other sides thereof are detachably connected. Each of the left frame and the right frame includes an upper main frame 20 and a lower main frame 21, the upper main frames 20 are used to be matched with the lower main frames 21 on the adjacent main frames 13, and the lower main frames 21 are used to be matched with the upper main frames 20 on the adjacent main frames 13. The left frame is provided with a connecting frame 18 used for interconnection between the adjacent main frames 13.

The adjacent main frames 13 are connected by the connecting frame 18 and a set screw, the main frames 13 ensure that the frame has enough rigidity to support a body, each of the main frames is further divided into the upper main frame 20 and the lower main frame 21 which are stretchable therebetween so as to be applied to mooring chains with different specifications, and the two parts are fixed by a set screw after being adjusted in size. A plurality of frame structures are connected by using spherical pairs 9, so that a certain angle may be formed by bending between every two adjacent modules. In addition, in view of a twisting action between adjacent chain knots of a mooring chain, moving wheels 5 are required to adapt to such change within a certain twisting range. Aluminum alloy has the characteristics of low density, high strength, good corrosion resistance and low machining cost, and therefore, aluminum alloy 6061-T6 is integrated in a mode such as welding and bolt connection so as to be used as the frame structure. Finally, the requirements on equipment layout and overall strength are met.

The frame structure is provided with a lifting hook 1.

The buoyancy system includes a plurality of buoyancy materials 11 disposed on the frame structure and used for supplying buoyancy for balancing the self-weight of the robot. Basic raw materials of the buoyancy materials 11 are made of hollow glass beads and epoxy resin according to a certain ratio and meet the requirement of environmental pressure. Materials such as oil varnishes are sprayed on outer surfaces of the buoyancy materials 11 to take the effect of corrosion resistance. The buoyancy materials 11 are installed and fixed to the main frames 13 of the frame structure by using set screws.

The propeller-propelled driving system includes vertical propellers 8 and horizontal propellers 14; the horizontal propellers 14 are symmetrically disposed on the frame structure, and the vertical propellers 8 are symmetrically disposed on the frame structure; and the vertical propellers 8 and the horizontal propellers 14 are respectively disposed on the different main frames 13 of the frame structure. The vertical propellers 8 and the horizontal propellers 14 may be fixedly installed on the frame structure by using set screws.

By disposing the vertical propellers 8 and the horizontal propellers 14, on one hand, the robot can move, navigate itself in place and return back, and on the other hand, the robot may be assisted to move up and down along the mooring chain. The horizontal propellers 14 and the vertical propellers 8 are disposed to be respectively close to longitudinal and vertical coordinates of the overall center of gravity of the robot.

The wheel-type driving system includes two pairs of moving wheels 5 disposed on the frame structure; and each pair of moving wheels 5 is perpendicular to each other and is located on different planes. The moving wheels 5 are provided with built-in motors 10; and the built-in motors 10 supply power for the rotation of the moving wheels 5.

The moving wheels 5 are installed on an output end of a clamping system. Furthermore, each pair of moving wheels 5 is away from each other. The distance between the pair of moving wheels 5 may be adjusted by the frame structure to adapt to various mooring chains. Each wheel is provided with one of the built-in motors 10 by which the robot is controlled to ascend and descend on the mooring chain. The robot may be subjected to fluid resistance and friction force between chain wheels when ascending and descending, wherein the friction force between the chain wheels is used as a driving force, and when the built-in motors 10 may not be used, the propellers may be started to make the robot move along the mooring chain.

The moving wheels 5 may be installed on the clamping system by using set screws.

The clamping system includes a lead screw 7 and an adjusting spring 15, the adjusting spring 15 is located on one side of each pair of moving wheels 5, the lead screw 7 and a screw nut 6 are matched on the other side of the adjusting spring 15, the other side of the adjusting spring 15 is connected to the lead screw 7, the lead screw 7 is rotatably installed on the frame structure, the screw nut 6 is disposed on an end of the lead screw 7, and thus, the screw nut 6 is driven to rotate. Then, the robot is clamped on the other side by virtue of the compression degree of the adjusting spring 15. The uneven surface of the mooring chain may be adapted by the stretching of the spring 15 in a moving process. Set screws are used to be connected with the main frames 13 of the frame structure.

The underwater observation and communication systems include underwater lights 4 and underwater cameras 3.

The underwater observation and communication systems are divided into two sets; one set is disposed inside the frame structure to play a role in checking the integrity of the mooring chain structure when climbing along the mooring chain; and the other set is located on the outer side of the frame structure to play a role in assisting the robot in moving and being in place underwater.

The cleaning system is located on the lowermost end of the frame structure, and the cleaning system includes a high-pressure water gun 12 disposed on the frame structure. The high-pressure water gun 12 may be fixed to the buoyancy materials 11 by using set screws and are disposed between the underwater camera 3 and the underwater light 4 which are disposed inside. When the robot advances, firstly, the high-pressure water gun 12 is used to clean the mooring chain, wherein full-area cleaning or fixed-point cleaning may be selected. During full-area cleaning, the degree of cleanliness of the surface of the mooring chain and the surface condition for the advancing of the moving wheels 5 may be improved, and the fixed-point cleaning means that a position required to be detected only needs to be cleaned.

The active clasping/unclasping system includes an external motor 16 and an electromagnet 19, and the external motor 16 and the electromagnet 19 are oppositely disposed and are disposed on the top end of the frame structure. The external motor 16 is disposed on an external motor installing platform 17 on the left frame or the right frame; the external motor installing platform 17 is disposed on a rotary connection side between the left frame and the right frame; and the electromagnet 19 is disposed on the other side of the left frame and the right frame and is used for attracting the left frame and the right frame together. The electromagnet 19 is a part of the connecting frame 18 on an opposite side. When the robot is unclasped, a command for cutting off power of the electromagnet 19 is given, and then, the external motor 16 is started to drive the frame to be unclasped; and when the robot needs to be clasped, the external motor 16 is started to drive the frame to be closed, and then, the electromagnet 19 is powered on, so that the robot is clasped.

The structural inspection system includes an underwater thickness tester 2, an underwater crack detector, a potential measuring instrument and the like which are carried according to a task demand.

In the present invention, by adopting a hybrid driving mode, the robot can autonomously reach a mooring chain working area to work in place; during work, the robot can be driven by wheels or a thrust to walk for work along the mooring chain; and after the work is finished, the robot autonomously returns the water surface and is recovered; autonomous in-place installation on the mooring chain is achieved without the assistance of manpower; during work, stable structural inspection work is achieved by controlling motions relative to the mooring chain; and for the structural inspection work of the mooring chain, firstly, marine growths attached to the surface of the mooring chain need to be cleaned, and by carrying a spraying and rinsing head for cleaning, synchronous work of cleaning and structural inspection can be achieved, so that the work efficiency is increased; in addition, adopted is an open frame structure which can be flexibly adjusted and configured according to various work loads, thereby also facilitating maintaining equipment.

Embodiment 2

An embodiment of the present invention further provides a working method of the hybrid-driven mooring chain cleaning and structural inspection underwater robot, including the following steps.

(1) The robot is gently placed on a position near a mooring chain, at the moment, the robot is in a clasping state.

Specifically, a lifting hook part of the robot is dragged by a crane on a mother ship, the umbilical is connected with the robot by an auto-unhooking device, and the robot is gently placed to a position near a mooring chain, at the moment, the robot is in a clasping state so as to be convenient for the robot to do the next work.

(2) After the robot is placed underwater for a certain distance, the robot freely floats to a position near the mooring chain under the drive of the thrusting system.

Specifically, after the robot is placed underwater for a certain distance, a command is sent to release the unhooking device, and the robot freely floats to a position near the mooring chain under the drive of the propeller-propelled driving system.

(3) The robot is switched from the clasping state to an unclasping state, and then, the thrusters drives the robot to move; and the mooring chain is enabled to enter the inside of the robot, at the moment, the external motor is driven to switch the robot to the clasping state.

Specifically, the robot is then switched from the clasping state to an unclasping state, and then, the propeller-propelled driving system is utilized to move the robot; and the mooring chain is enabled to enter the inside of the robot, at the moment, the external motor is driven to switch the robot to the clasping state, and at the moment, the two sets of moving wheels of the robot clasp the mooring chain to supply enough pressure, thereby ensuring that the robot moves on the mooring chain later.

(4) If the robot is incompatible with the mooring chain in specification, relative positions of the robot and the mooring chain are adjusted.

Specifically, if the robot is incompatible with the mooring chain in specification, relative positions of the robot and the mooring chain are finely adjusted by the propellers.

(5) Cleaning and structural inspection work is performed. The cleaning device carried by the robot is located below the robot, and an underwater motor drives wheels of the robot to move along the mooring chain ater the robot enters water; firstly, the mooring chain is cleaned at the same time, the underwater observation and communication systems are located right above the robot, and a turbid environment is kept away during work in a cleaning area, so that it is convenient to observe the mooring chain and detect the thickness and cracks of the mooring chain.

(6) After finishing the work, the robot returns to the water surface, then, the robot is controlled to be switched from the clasping state to the unclasping state, separated from the mooring chain, and then, restored to the clasping state.

What is claimed is:

1. A hybrid-driven mooring chain cleaning and structural inspection underwater robot, comprising at least one frame structure;

a buoyancy system disposed on the frame structure and used for adjusting the buoyancy of the robot;

a driving system disposed on the frame structure;

wherein the driving system comprises a propeller-propelled driving system and a wheel-type driving system; the propeller-propelled driving system is used for supplying power for underwater motions; and the wheel-type driving system is used for driving the robot to move on a mooring chain;

wherein the wheel-type driving system comprises two pairs of moving wheels disposed on the frame structure; and each pair of moving wheels is perpendicular to each other and is located on different planes;

underwater observation and communication systems disposed on the frame structure and used for underwater observation;

a cleaning system disposed on the frame structure and used for cleaning the mooring chain;

an active clasping/unclasping system disposed on the frame structure and used to be switched between two working states of underwater motions and chain climbing motion;

wherein the active clasping/unclasping system comprises an external motor and an electromagnet, and the external motor and the electromagnet are oppositely disposed and are disposed on a top end of the frame structure; and a structural inspection system disposed on the frame structure.

2. The hybrid-driven mooring chain cleaning and structural inspection underwater robot of claim 1, wherein the buoyancy system comprises a plurality of buoyancy materials disposed on the frame structure.

3. The hybrid-driven mooring chain cleaning and structural inspection underwater robot of claim 1, wherein the propeller-propelled driving system comprises vertical propellers and horizontal propellers; the horizontal propellers are symmetrically disposed on the frame structure, and the vertical propellers are symmetrically disposed on the frame structure; and the vertical propellers and the horizontal propellers are respectively disposed on different main frames of the frame structure.

4. The hybrid-driven mooring chain cleaning and structural inspection underwater robot of claim 1, wherein a clamping system comprises a lead screw and an adjusting spring, the adjusting spring is located on one side of each pair of moving wheels, the lead screw and a screw nut are matched on the other side of the adjusting spring, the other side of the adjusting spring is connected to the lead screw, the lead screw is rotatably installed on the frame structure, and the screw nut is disposed on an end of the lead screw.

5. The hybrid-driven mooring chain cleaning and structural inspection underwater A robot of claim 1, wherein the cleaning system is located on a lowermost end of the frame structure, and the cleaning system comprises a high-pressure water gun disposed on the frame structure.

6. A working method of the hybrid-driven mooring chain cleaning and structural inspection underwater robot of claim 1, comprising the following steps:

gently placing the robot on a position near a mooring chain, at the moment, enabling the robot to be in a clasping state;

after the robot is placed underwater for a certain distance, enabling the robot to freely float to a position near the mooring chain under the drive of the propeller-propelled driving system;

switching the robot from the clasping state to an unclasping state, and then, driving, by the driving system, the robot to move; and enabling the mooring chain to enter the inside of the robot, at the moment, driving the external motor to switch the robot to the clasping state;

if the robot is incompatible with the mooring chain in specification, adjusting relative positions of the robot and the mooring chain;

locating the cleaning device carried by the robot below the robot, and driving, by an underwater motor, wheels of the robot to move along the mooring chain after the robot enters water; firstly, cleaning the mooring chain at the same time, locating the underwater observation and communication systems right above the robot, and keeping away from a turbid environment during work in a cleaning area; and after finishing the work, returning the robot to the water surface, and then, controlling the robot to be switched from the clasping state to the unclasping state, separated from the mooring chain, and then, restored to the clasping state, and recovering the robot by virtue of a mother ship.

* * * * *